US005094317A

United States Patent [19]

Ladendorf

[11] Patent Number: 5,094,317

[45] Date of Patent: Mar. 10, 1992

[54] TWO-PIECE MEGAPHONE WITH ORNAMENTAL MEMBER

[76] Inventor: Richard A. Ladendorf, 4412 Washburn Ave. South, Minneapolis, Minn. 55410

[21] Appl. No.: 621,246

[22] Filed: Nov. 30, 1990

[51] Int. Cl.[5] ..... G10K 11/00

[52] U.S. Cl. ..... 181/178; 181/179; 181/190; D14/204

[58] Field of Search ..... 181/148, 150, 151, 175, 181/177, 178, 179, 189, 190, 199; D14/187, 204, 267, 216, 208; D21/153, 211

[56] References Cited

U.S. PATENT DOCUMENTS

| | | | |
|---|---|---|---|
| D. 202,431 | 9/1965 | Turner | D14/207 |
| D. 303,530 | 9/1989 | Baer | D14/204 |
| 673,396 | 5/1901 | Hogan | 181/178 |
| 936,910 | 10/1909 | Kingsley | 181/178 |
| 1,571,414 | 2/1926 | Jensen | 181/178 |
| 1,613,001 | 1/1927 | Wilhelm | 181/178 |
| 1,662,742 | 3/1928 | Glassman | 181/152 X |
| 2,517,665 | 8/1950 | Hochstein | 181/178 |
| 4,613,012 | 9/1986 | Mueller, III | 181/178 |
| 4,869,702 | 9/1989 | Derby, III | 446/329 |

FOREIGN PATENT DOCUMENTS

| | | | |
|---|---|---|---|
| 153067 | 7/1904 | Fed. Rep. of Germany | 181/177 |
| 25617 | of 1904 | United Kingdom | 181/190 |

*Primary Examiner*—Brian W. Brown
*Attorney, Agent, or Firm*—Kinney & Lange

[57] ABSTRACT

A two-piece megaphone assembly having a conically-shaped member and an ornamental headpiece which attaches by means of interlocking attachment lugs to the large diameter end of the conically-shaped member. The headpiece is comprised of two symmetrical halves which fold clamshell-like around the conically-shaped member and snap into place. The headpiece may resemble, for example, an animal or human face having an open mouth.

17 Claims, 6 Drawing Sheets

Fig. 3
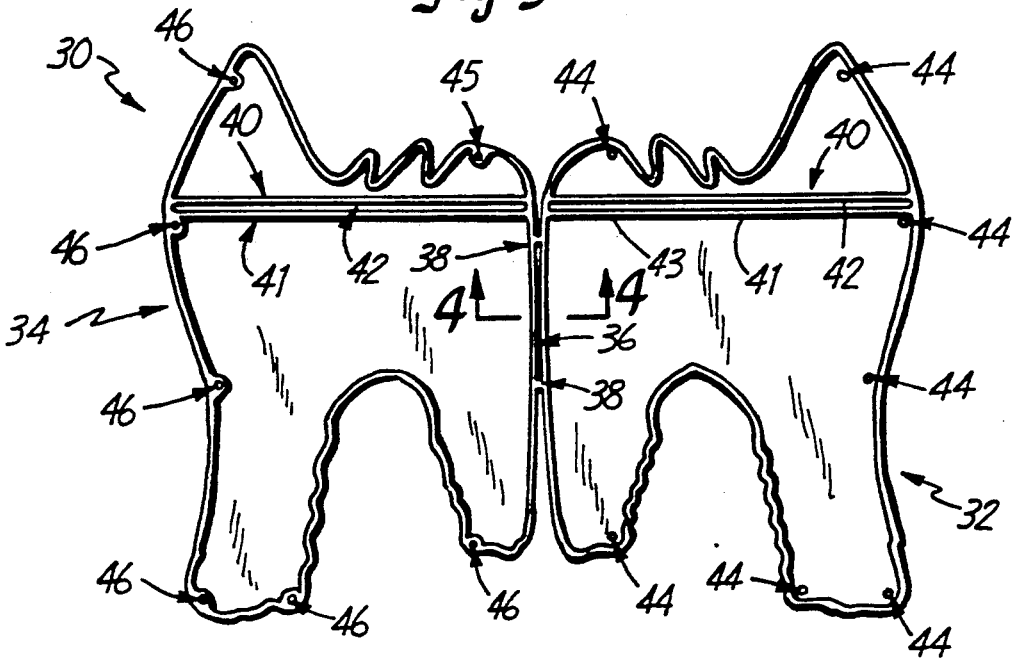
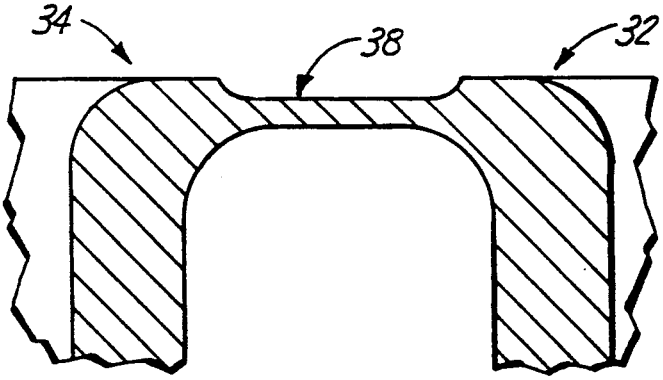
Fig. 4
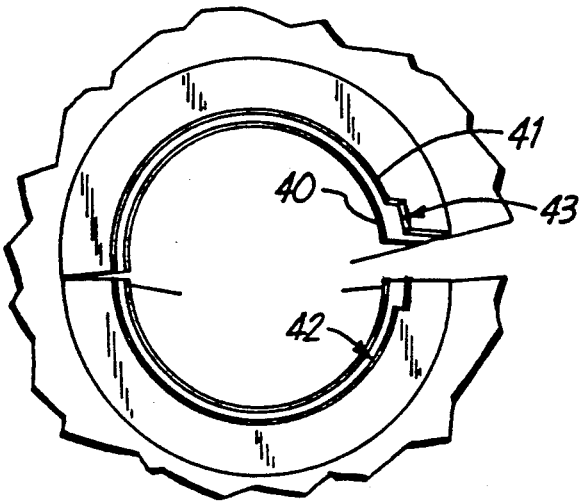
Fig. 5

Fig. 6
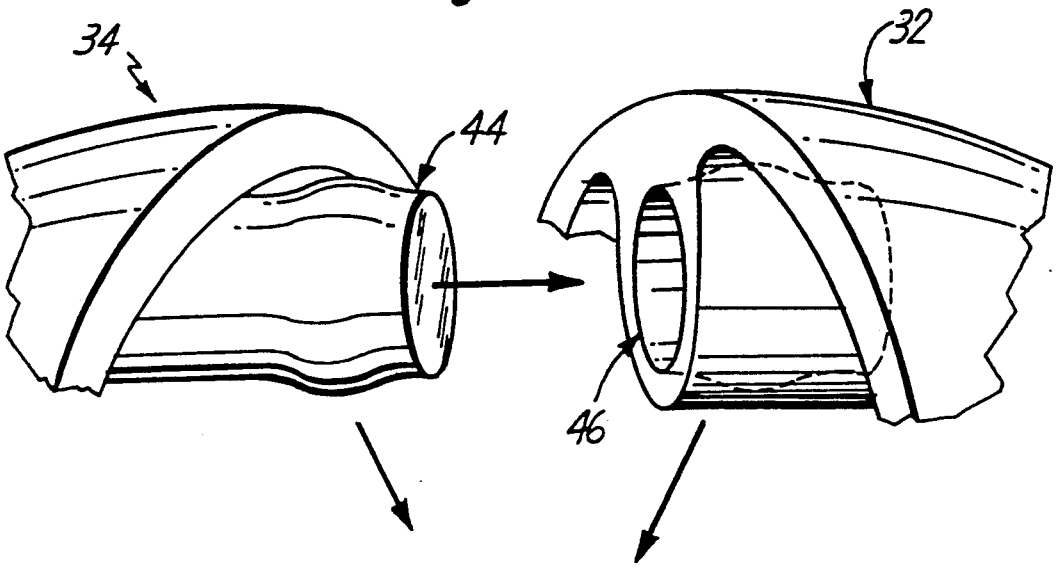
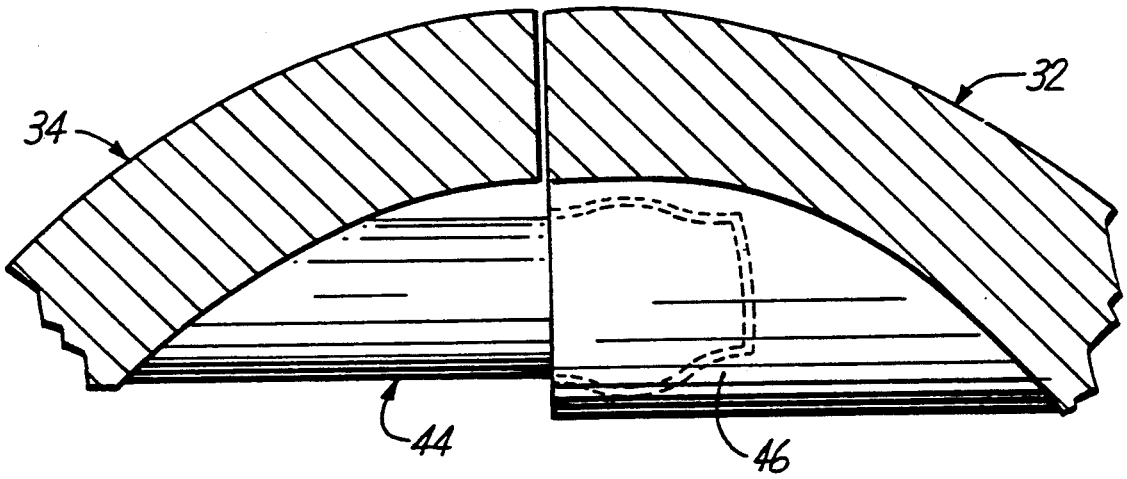
Fig. 7

TWO-PIECE MEGAPHONE WITH ORNAMENTAL MEMBER

BACKGROUND OF THE INVENTION

The present invention relates to a megaphone for sound directing and apparent sound amplification. In particular, the present invention is a two-piece megaphone having a conical member and an ornamental headpiece attached to the large diameter of the conical member.

Conical frustum-shaped, hollow pipes have been in use for thousands of years as a method of directing sound. Sound waves emanating omni-directionally from a point source (or a small area such as the human mouth) diminish rapidly in intensity as the wave front spreads. If the sound is introduced into a hollow, conically-shaped pipe, it is guided into a straighter, more unidirectional path by internal refractions within the pipe. An increase in apparent intensity is experienced by an observer some distance away in the directed path of the sound. A hollow, conical pipe along, by virtue of it being a passive device, adds no energy to the emitted sound waves. Thus, sound emanating from a conically-shaped pipe is apparently amplified in a preferred direction at the cost of sound attenuation in other, non-preferred directions.

A megaphone is a hollow, conically-shaped pipe sized for directing and apparently amplifying the human voice. Commonly used by cheerleaders and spectators at sporting events and other crowd gatherings, megaphones have been in use since before the beginning of the twentieth century. Folded or rolled paper megaphones with advertising or promotional messages have been sold or given away at sporting events in the United States since the turn of the century. U.S. Pat. No. 936,910 to Kingsley discloses such a megaphone. The prior art also includes attempts to add distinguishing features, such as the flattenable, square pyramidal frustum-shaped megaphone disclosed in U.S Pat. No. 1,613,001 to Wilhelm, which also includes provisions for an integral pencil holder.

A review of the prior art also discloses attempts at adding three-dimensional decorative shapes to the generally conical underlying shape of the megaphone, such as disclosed in U.S. Pat. No. Des 303,530 to Baer.

Since megaphones are often distributed as free or low cost promotional material, the cost of manufacture is an overriding concern. In a like vein, costs associated with storage and shipping must be minimized.

The decorative face disclosed in the Baer reference, in which the large diameter end of the megaphone is shaped into a representation of an open mouth, is a three-dimensionally enhanced megaphone configuration. However, the megaphone design disclosed in the Baer reference suffers cost disadvantages because it is composed of five individually manufactured pieces. The megaphone disclosed in the Baer reference, as in much of the other prior art, including U.S. Pat. No. 4,613,012 to Mueller, III and U.S. Pat. No. 2,517,665 to Hochstein, all suffer from the limited durability inherent in the rolled or folded paper construction employed.

SUMMARY OF THE INVENTION

The present invention is a two-piece megaphone comprised of a standardized, conical frustum-shaped member and ornamental headpiece attached to the large diameter (distal) end of the conical member.

The conical member of the present invention can be economically shipped by nesting many conical members within one another. The conical member has, in one preferred embodiment, integral attachment lugs protruding from its distal end for attachment of the headpiece. Preferably, the conical member also has holes in its small diameter (proximal) end, through which a carrying string or strap may be threaded.

The ornamental headpiece is comprised of a pliable plastic molded into any one of numerous unique shapes, such as an animal face representing a team mascot. In one preferred embodiment, the animal face has an open mouth through which sound can exit the megaphone. The headpiece is manufactured out of a pliable material and is preformed into two symmetrical halves, joined by a hinged seam, which fold clamshell fashion together during assembly. When the two clamshell-like halves are open, they can be space efficiently stacked for storage in transport. The opposing side edges of the two symmetrical halves have integral mating lugs.

During assembly of the headpiece to the conical member, which can be accomplished at the point of sale or by the end user, the headpiece is folded around the distal end of the conical member and the mating lugs snapped together. The inside surface of the headpiece also incorporates cavities which interlockingly engage with the attachment lugs protruding from the distal end of the conical member.

BRIEF DESCRIPTION OF THE DRAWINGS

FIG. 3 is a top view of an ornamental headpiece prior to assembly in accordance with the present invention.

FIG. 4 is a cross-sectional view of the ornamental headpiece in accordance with this invention, taken along line A—A of FIG. 3.

FIG. 5 is a detailed perspective view of the inwardly projecting attachment lugs in accordance with the present invention.

FIG. 6 is a detailed perspective view of interlocking engagements tabs and orifices prior to assembly in accordance with the present invention.

FIG. 7 is a detailed cross-sectional side view of the engagement tabs and orifices of FIG. 6 after assembly in accordance with the present invention.

DETAILED DESCRIPTION OF THE PREFERRED EMBODIMENTS

Figure 1:
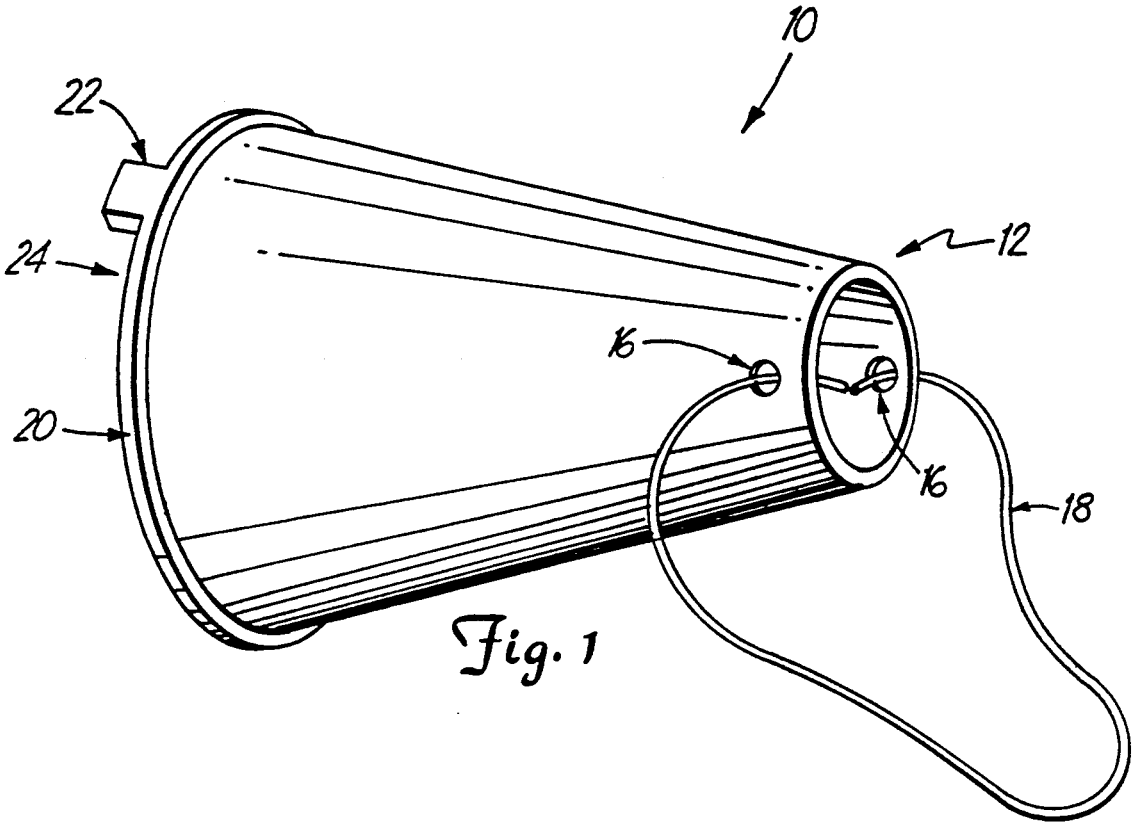
FIG. 1 is a perspective view of a conically-shaped member prior to assembly in accordance with the present invention.

A perspective view of a conically-shaped member 10 made in accordance with the present invention is shown in FIG. 1. Conically-shaped member 10 has proximal end 12 and distal end 14. Proximal end 12 has holes 16, through which the ends of carrying strap 18 may be threaded. Distal end 14 has an integral ring-shaped lip 20 projecting radially outward from the central longitudinal axis (not shown) of conically-shaped member 10. Distal end 14 also has an essentially rectangular planar locating tab 22 projecting in a direction generally parallel to the longitudinal axis (not shown). Ring-shaped lip 20 and locating tab 22 together comprise outwardly projecting integral attachment lugs 24. Conically-shaped member 10 may be comprised of, for example, injection molded polypropylene plastic, and formed with no dangerously sharp edges. Conically-shaped member 10 can be produced in large, economically advantageous quantities and space efficiently stacked (sans carrying strap) by partially nesting of multiple members within one another for economical storage and transport.

Figure 2:
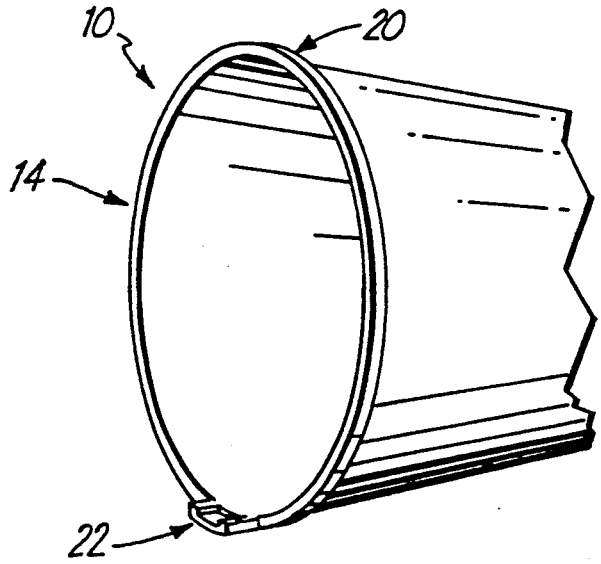
FIG. 2 is a detailed perspective view of the distal end of the conically-shaped member of FIG. 1 in accordance with the present invention.

Distal end 14 is shown in FIG. 2, which is a detailed perspective view of the conically-shaped member 10 of FIG. 1. Locating tab 22 projects from the periphery of distal end 14 in a direction generally parallel to the longitudinal axis (not shown) of conically-shaped member 10. Ring-shaped lip 20 projects radially from the circumferential periphery of distal end 14.

An ornamental headpiece 30 in an open, as-manufactured state, prior to assembly, is shown in FIG. 3. Ornamental headpiece 30 may be comprised of, for example, pliable polypropylene plastic which has been molded into two symmetrical halves joined by a pliable hinge seam and forming a closable clamshell-like assembly. During final assembly, ornamental headpiece 30 is closed around distal end 14 of conically-shaped member 10 and fastened into position.

FIG. 3 is a top view showing the surface of ornamental headpiece 30 which will become the inside surface of headpiece 30 when it is closed around distal end 14 of conically-shaped member 10 (shown in FIGS. 1 and 2).

Headpiece 30 is comprised of left half 32 and right half 34 which are symmetrical to each other about integral hinge seam 36 where they are joined by at least one integral hinge strap 38. Left half 32, right half 34, and hinge seam 36 together comprise a foldable, clamshell-like assembly.

Headpiece 30 is also comprised of integral projections including ring-shaped proximal circular lip 40 and distal circular lip 41, which are shown in detail in FIG. 5. When headpiece 30 is closed and assembled with conically-shaped member 10, slot 42, which is the space between proximal lip 40 and distal lip 41, snugly receives ring-shaped lip 20 of member 10. An open area 43 is present in distal lip 41 to receive locating tab 22 (shown in FIGS. 1 and 2) when left half 32 and right half 34 are closed around conically-shaped member 10 (shown in FIGS. 1 and 2).

Engagement tabs 44, having a bulging cylindrical shape, are positioned along the periphery of left half 32 and project outward from headpiece 30. Orifices 46 are located along the periphery of right half 34 in symmetrically corresponding positions to engagement tabs 44. When headpiece 30 is closed into its final form, engagement tabs 44 are forced into corresponding orifices 46 (shown in detail in FIGS. 6 and 7) to fasten the side edges of left half 32 to the side edges of right half 34, thus forming the seam.

Hinge strap 38 is shown in detail in FIG. 4 which is a cross-sectional view taken along the line A—A of FIG. 3. Left half 32 and right half 34 of headpiece 30 may, for example, have a wall thickness of 0.006 inches. In contrast, hinge strap 38 may, for example, have a wall thickness of 0.0015 inches. When left half 32 and right half 34 are folded together during assembly, the pliable plastic material of hinge strap 38 conforms to provide means for the clamshell-like folding movement.

An integral engagement tab 44 is shown just prior to insertion in orifice 46 in FIG. 6 which is a detailed perspective view of a portion of the headpiece of FIG. 3. FIG. 7 is a cross-sectional view of the engagement tab 44 and orifice 46 of FIG. 6 after assembly. The bulge in engagement tabs 44 necessitate application of some force to press engagement tabs 44 into orifices 46. When left half 32 and right half 34 are folded together around distal end 14 of member 10, the force required to press tabs 44 into orifices 46 results in left half 32 and right half 34 "snapping" and firmly attaching together.

Figure 8:
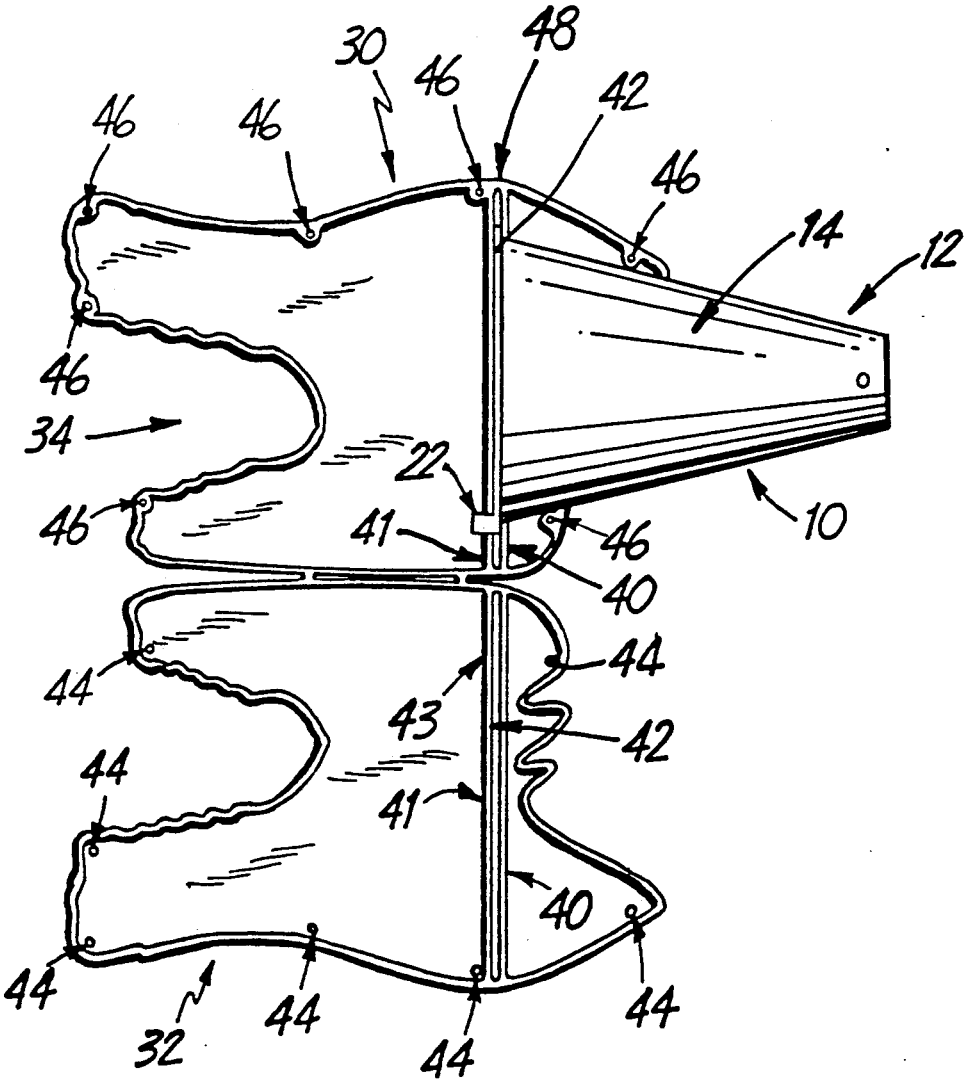
FIG. 8 is a top view of the conical member of FIG. 1 and the ornamental headpiece of FIG. 3 in position for final assembly in accordance with the present invention.

Conically-shaped member 10 is shown resting in ornamental headpiece 30 just prior to final assembly in FIG. 8, which is a top view. Ring-shaped lip 20 of member 10 is shown nesting in slot 42 between proximal ring-shaped lip 40 and distal ring-shaped lip 41 of right half 34 of headpiece 30. When left half 32 and right half 34 are folded, engagement tabs 44 snap into orifices 46. When left half 32 and right half 34 are folded and snapped together, locating tab 22 is received in slot 43 of left half 32. When left half 32 and right half 34 are folded and snapped together, a portion of lip 20 is pushed between lip 40 and lip 41 of left half 32. Lip 20 and tab 22 of member 10, together with proximal lip 40 and distal lip 41 of headpiece 30, comprise interlocking attachment lugs 48 which prevent significant relative motion between member 10 and headpiece 30, when headpiece 30 is assembled onto distal end 14 of member 10.

Figure 9:
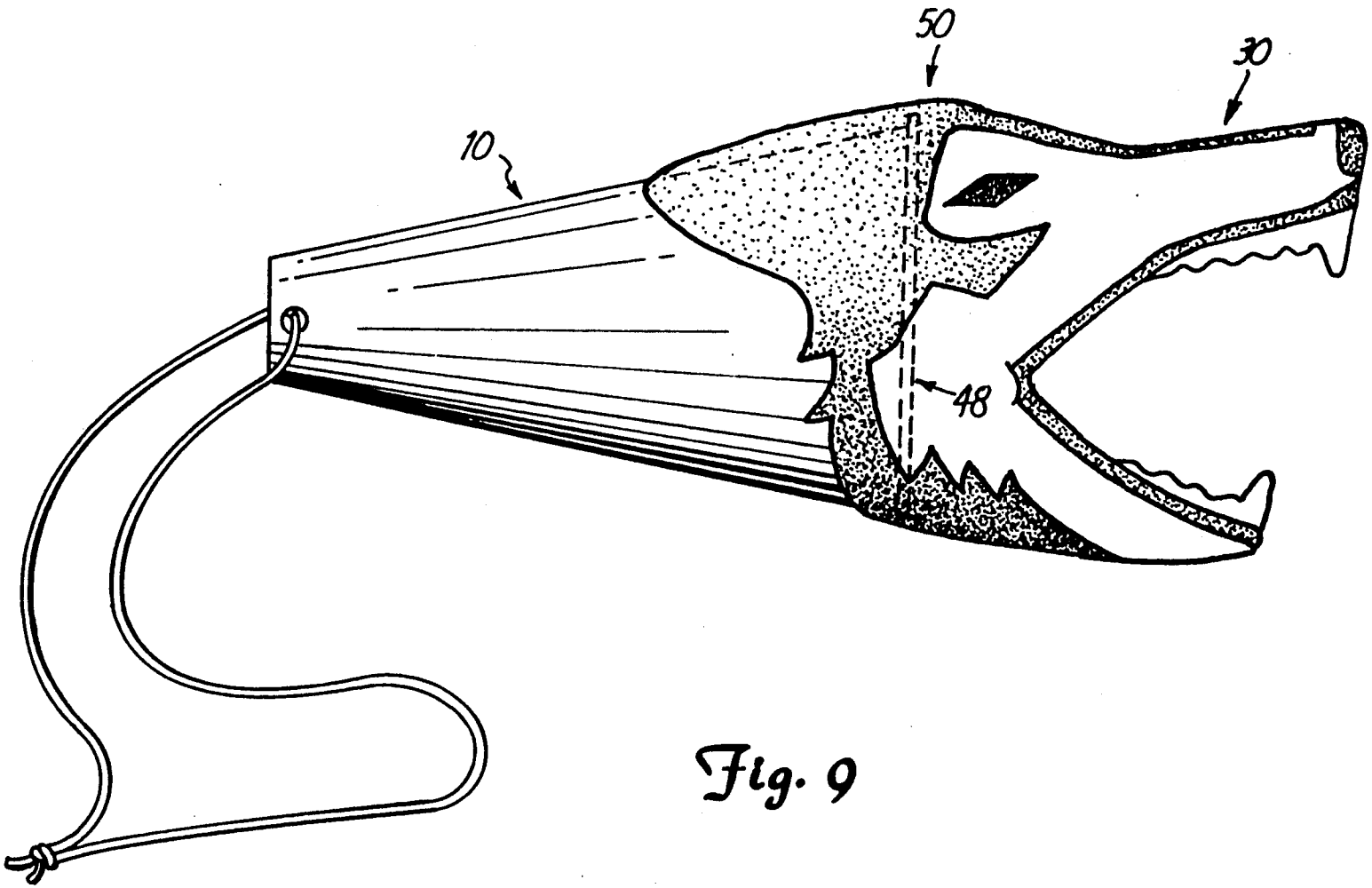
FIG. 9 is a side view of a completed megaphone assembly in accordance with the present invention.
Figure 10:
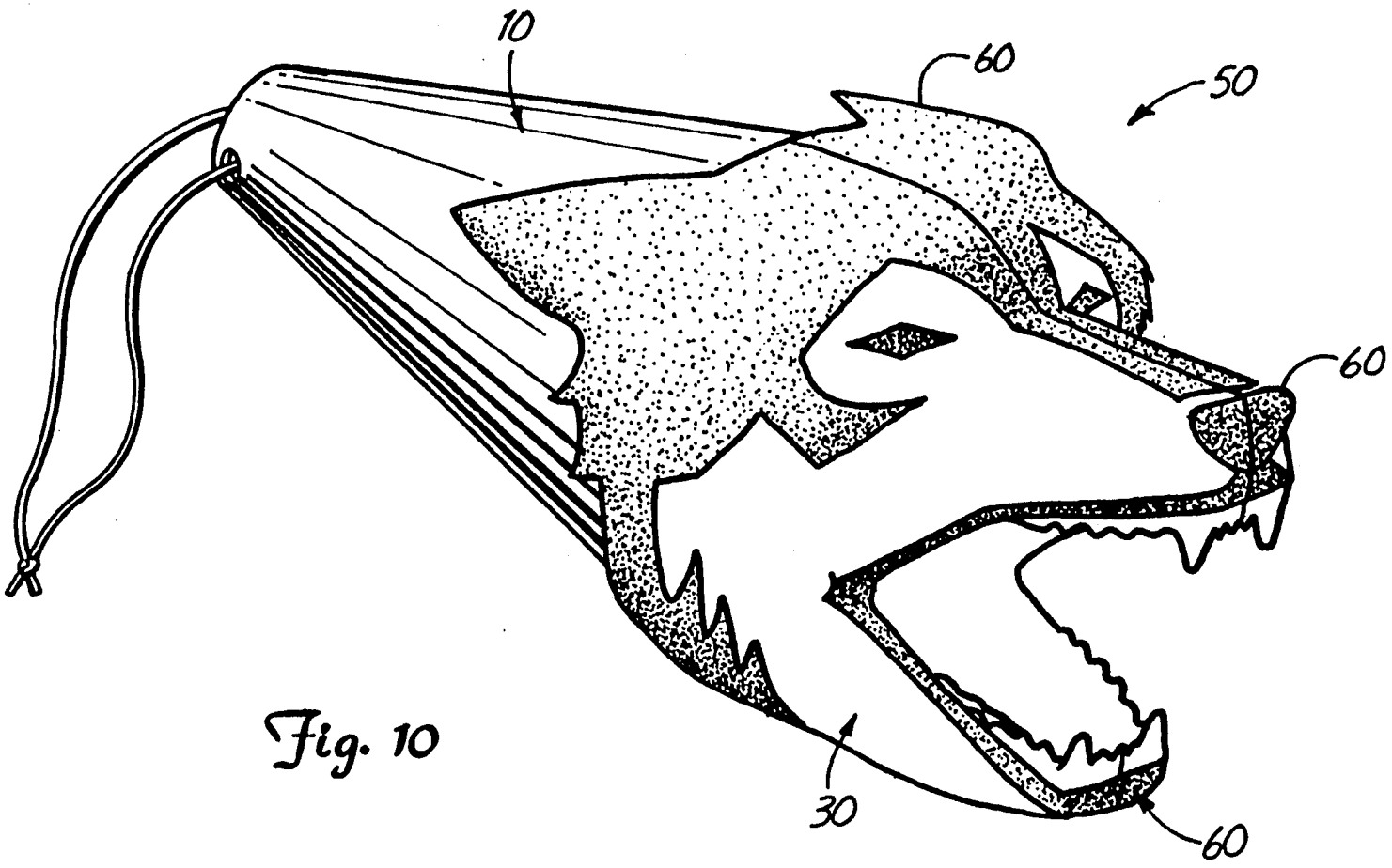
FIG. 10 is a perspective view of the completed megaphone assembly.

A complete megaphone assembly 50 is shown in side and perspective views in FIGS. 9 and 10. Ornamental headpiece 30 is shown assembled on the distal end of member 10. A portion of headpiece 30 covers interlocking attachment lugs 48 (hidden and shown by dashed lines in FIG. 9). Although in the preferred embodiment shown in FIG. 9, headpiece 30 resembles the face of a canine, headpiece 30 can be manufactured to resemble any of a variety of animal or human faces or other decorative shapes. In order to enhance the appearance of headpiece 30, one or more colors of paint may be applied. Additionally, one or more colors of paint may be applied to member 10 to further enhance the appearance of megaphone assembly 50, as illustrated by painted areas 60 in FIG. 10. Furthermore, the pattern of paint color applied to member 10 may match the pattern of paint color applied to headpiece 30. Locating tab 22, in conjunction with open area 43 in lip 41 (not shown), acts to prevent relative rotational motion between member 10 and headpiece 30 about the megaphone's central longitudinal axis (not shown). The alignment function of locating tab 22 enables mass production of members 10 and headpieces 30 having complimentary color patterns which will be in register with one another after final assembly.

Although the present invention has been described with reference to preferred embodiments, workers skilled in the art will recognize that changes may be made in form and detail without departing from the spirit and scope of the invention.

What is claimed is:

1. A megaphone assembly for sound direction and apparent sound amplification comprising:

a hollow, conically-shaped member having a small diameter proximal end for introduction of sound and a large diameter distal end, wherein the distal end of the conically-shaped member has integral outwardly projecting attachment lugs: and a hollow, ornamental headpiece shell having a proximal end and a distal end, wherein the proximal end of the headpiece shell has integral inwardly projecting attachment lugs which interlockingly engage with the outwardly projecting attachment lugs of the conically-shaped member for fastening the headpiece to the conically-shaped member.

2. The megaphone assembly of claim 1 wherein the proximal end of the headpiece shell surrounds a portion of the distal end of the conical member, thereby concealing the attachment lugs.

3. The megaphone assembly of claim 2 wherein the conically-shaped member has a longitudinal central axis and wherein the attachment lugs projecting outwardly from the distal end of the conically-shaped member include an integral, ring-shaped lip projecting radially outward in a direction generally perpendicular to the longitudinal axis and at least one locating tab projecting in a direction generally parallel to the longitudinal axis.

4. The megaphone assembly of claim 3 wherein the headpiece shell has a longitudinal central axis and wherein the attachment lugs projecting inwardly from the headpiece shell include at least two integral, ring-shaped lips projecting radially inward in a direction generally perpendicular to the longitudinal axis of the headpiece and aligned with each other such that a ring-shaped slot is present between them, wherein the ring-shaped slot is of sufficient size to house the ring-shaped lip projecting outward from the conically-shaped member.

5. The megaphone assembly of claim 1 wherein the ornamental headpiece shell comprises two symmetrical halves joined in a plane parallel to the central axis by at least one integral seam of pliable material.

6. The megaphone assembly of claim 5 wherein a wall thickness of the integral seam is less than a wall thickness of the symmetrical halves.

7. The megaphone assembly of claim 5 wherein the two symmetrical halves are further joined in the plane parallel to the central axis diametrically opposite the integral seam of pliable material by interlocking engagement tabs and orifices.

8. The megaphone assembly of claim 1 wherein the headpiece shell is formed in the shape of an animal face having an open mouth.

9. The megaphone assembly of claim 1 wherein the ornamental headpiece shell has a contoured outer surface and wherein the outer surface is at least partially covered by at least one color of paint to further clarify and enhance a represented shape.

10. A megaphone assembly for sound direction and sound amplification comprising:

a hollow, conically-shaped member having a central longitudinal axis, a small diameter proximal end, a large diameter distal end, and first attachment means adjacent the distal end; and a hollow, ornamental headpiece shall having a central longitudinal axis, a proximal end, a distal end, and second attachment means adjacent the proximal end for engagement with the first attachment means, wherein the first and second attachment means are positioned and shaped so as to provide an interlocking attachment to securely fasten the proximal end of the headpiece shell to the distal end of the conically-shaped member and thereby aligning the longitudinal axis of the shell with the longitudinal axis of the conically-shaped member along a common axial line.

11. The megaphone assembly of claim 10 wherein the proximal end of the headpiece shell surrounds a portion of the distal end of the conical member, thereby concealing the first and second attachment means.

12. The megaphone assembly of claim 10 wherein the headpiece shell is formed in the shape of an animal face having an open mouth.

13. The megaphone assembly of claim 10 wherein the ornamental headpiece shell has an outer surface and wherein the outer surface is at least partially covered by at least one color of paint to further clarify and enhance a represented shape.

14. The megaphone assembly of claim 10 wherein the first attachment means includes outwardly projecting integral attachment lugs.

15. The megaphone assembly of claim 10 wherein the second attachment means includes inwardly projecting integral attachment lugs.

16. The megaphone assembly of claim 10 wherein the conically-shaped member and the headpiece shell have integrally formed, cooperating alignment elements which dictate a predetermined circumferential alignment of the conically-shaped member and the headpiece shell.

17. The megaphone assembly of claim 10 wherein the headpiece shell has two symmetrical halves which are connected by a hinge.

* * * * *